US005528988A

United States Patent [19]

Lindgren et al.

[11] Patent Number: 5,528,988

[45] Date of Patent: Jun. 25, 1996

[54] SHOT PELLETS FOR WILD GAME HUNTING AND A METHOD FOR ITS MANUFACTURE

[75] Inventors: Per-Olof Lindgren; Karl-Erik Johansson, both of SkellefteÅ ; Kjell-Åke Johansson, Ursviken; Karin Paulsson, Skelleftehamn, all of Sweden

[73] Assignee: Boliden Mineral AB, Skelleftehamn, Sweden

[21] Appl. No.: 232,111

[22] PCT Filed: Oct. 6, 1993

[86] PCT No.: PCT/SE93/00808

§ 371 Date: May 3, 1994

§ 102(e) Date: May 3, 1994

[87] PCT Pub. No.: WO94/08199

PCT Pub. Date: Apr. 14, 1994

[30] Foreign Application Priority Data

Oct. 13, 1992 [SE] Sweden ..... 9202926

[51] Int. Cl.[6] ..... F42B 7/04

[52] U.S. Cl. ..... 102/459; 29/1.23; 102/514

[58] Field of Search ..... 102/459, 501, 102/514, 516; 29/1.22, 1.23

[56] References Cited

U.S. PATENT DOCUMENTS

| | | | |
|---|---|---|---|
| 204,298 | 5/1878 | Crooke | 102/514 |
| 1,732,211 | 10/1929 | Olin et al. | 102/514 |
| 1,865,727 | 7/1932 | Schuricht et al. | 102/459 |
| 1,916,465 | 11/1933 | Dawson | 102/514 |
| 1,992,244 | 2/1935 | Schuricht | 102/459 |
| 2,336,143 | 12/1943 | Werme | 102/516 |
| 3,349,711 | 10/1967 | Darigo et al. | 102/514 |
| 4,387,492 | 6/1983 | Inman | 102/514 |
| 5,079,814 | 1/1992 | Moore et al. | 102/504 |

FOREIGN PATENT DOCUMENTS

| | | | |
|---|---|---|---|
| 632885 | 1/1928 | France | 102/514 |
| 105415 | 4/1917 | United Kingdom | 102/514 |
| 279781 | 3/1928 | United Kingdom | 102/514 |

*Primary Examiner*—Harold J. Tudor
*Attorney, Agent, or Firm*—Burns, Doane, Swecker & Mathis

[57] ABSTRACT

The invention relates to shot pellets for hunting wild game, particularly birds on wet marshlands. The pellets are also suitable for clay pigeon shooting on organized skeet ranges. The shot pellets have an inner core comprised of lead or lead alloy, and an outer layer of silver or silver alloy. The shot pellets are not influenced, or only slightly influenced by a strong hydrochloric acid environment, therewith greatly eliminating the risk of lead leaching from the pellets. The shot pellets are produced by coating shot pellet cores of lead or lead alloy electrochemically with at least one layer, wherein the outermost layer is always comprised of silver or a silver alloy.

22 Claims, 3 Drawing Sheets

SHOT PELLETS FOR WILD GAME HUNTING AND A METHOD FOR ITS MANUFACTURE

BACKGROUND OF THE INVENTION

The present invention relates to shot such as BB-shot pellets, for wild game hunting and particularly for hunting birds on wet marshlands and for clay pigeon shooting from organized skeet ranges.

Large numbers of lead shot pellets are used worldwide when hunting wild game, particularly when hunting birds. The majority of the pellets fail to hit the target, and fall relatively undamaged to the ground or settle on the bottom of waterways and lakes. With time, more and more lead pellets accumulate on the ground and on the bottoms of lakes and rivers.

Investigations have shown that over the last decennium sea birds in particular have shown signs of lead poisoning. It has been established that the birds ingest lead pellets from the ground or from the bottom of rivers and lakes in their search for food and also for gravel to assist in digestion of the food ingested.

The lead pellets remain in the gizzard of the bird for from 7 to 15 calendar days. The gastric juices produced by birds are relatively acid and have a pH of about 1 and contains mainly hydrochloric acid, and consequently large quantities of lead are leached from the pellets. The leached lead then travels through the blood vessels to vital body organs and causes suffering and, in many cases, the death of the animal or bird concerned. According to scientific research, the ability of such creatures to reproduce is also affected by the ingestion of lead. The risk increases in areas that are densely populated by sea birds, where hunting is highly intensive.

Progressively more countries forbid the use of lead shot for hunting birds on wet marsh lands, lakes, rivers and other waterways, so as to avoid subjecting the birds to lead poisoning. The use of lead shot pellets over land is also prohibited, so as to avoid lead leaching from lead pellets in natural habitats. The use of lead shot pellets on clay pigeon skeet ranges is quantitatively much greater than the use to hunt birds on wet marshlands etc. This results in an undesirable local accumulation of lead, and the use of lead shot for clay pigeon shooting thus constitutes an environmental problem.

At present time, the alternative to lead shot is iron or steel shot. Bi-shot is available, although only in very limited quantities. Steel and iron shot, however, are encumbered with other serious drawbacks and hunters have reacted strongly against the use of such shot. Among other things, the relative density of such shot is 30% lower than the relative density of lead, and therefore requires a larger explosive charge to propel the pellets, with the accompanying risk of fracturing the barrel of the gun concerned and also of lowering the penetrating force of the pellets and therewith causing more injuries than deaths to the animals or birds struck by the pellets. The use of steel and iron pellet also results in much heavier wear on the gun barrels. Sparks generated by ricochets and subsequent danger of fire also constitute a serious risk when hunting with iron or steel pellet.

There is thus a need, at least when hunting so-called swimming birds on lakes and rivers, for shot pellets which while possessing all the positive properties of lead shot pellets will, at the same time, eliminate the negative aspects of lead pellet mentioned in the introduction, such as the lead poisoning of birds, for instance. Such lead shot pellets will also preferably have a negligible influence on skeet ranges and their surroundings.

It has earlier been proposed to coat lead shot pellets with copper or nickel, so as to enhance resistance against the leaching of lead in acid environments, and shot pellets of this nature has also been sold commercially to a limited extent. GB-A 2,111,176 proposes the use of shot pellets on which a coating of tin has been electrolytically applied. Comparison tests carried out in conjunction with the production of tin coated pellet showed that a "critical" dissolution was reached within one hour in the case of conventional uncoated lead shot pellets, whereas the tin coated shot pellets showed roughly a tenfold improvement over conventional shot pellets and roughly a five-fold improvement over nickel coated shot pellets. No tin coated shot pellets have been retailed commercially, however, probably because the improved leaching resistance of the pellets has been judged insufficient to be able to eliminate reasonably the aforesaid drawbacks and problems associated with the use of lead pellets.

SUMMARY OF THE INVENTION

The present invention surprisingly makes possible the provision of shot pellets that are safer to use when hunting wild game, and particularly when hunting birds on wet marshlands etc., and for clay pigeon shooting and that can be characterized as being inert in the present context. The invention also relates to a method for manufacturing such shot pellets. The invention is characterized by the features set forth in the respective product and method Claims.

The inventive shot pellet thus includes an inner core of lead or lead alloy, and an outer layer of silver or silver alloy applied electrochemically to the core. The pellet is not influenced by a strong hydrochloric acid environment, therewith essentially eliminating the danger of lead leaching from the pellet. By "strong hydrochloric acid environment" is meant a strong acid environment which corresponds to the environment of the gizzard of a bird, where the acidity may be in the order of pH 1.

DETAILED DESCRIPTION OF THE PREFERRED EMBODIMENTS OF THE INVENTION

Figure 1:
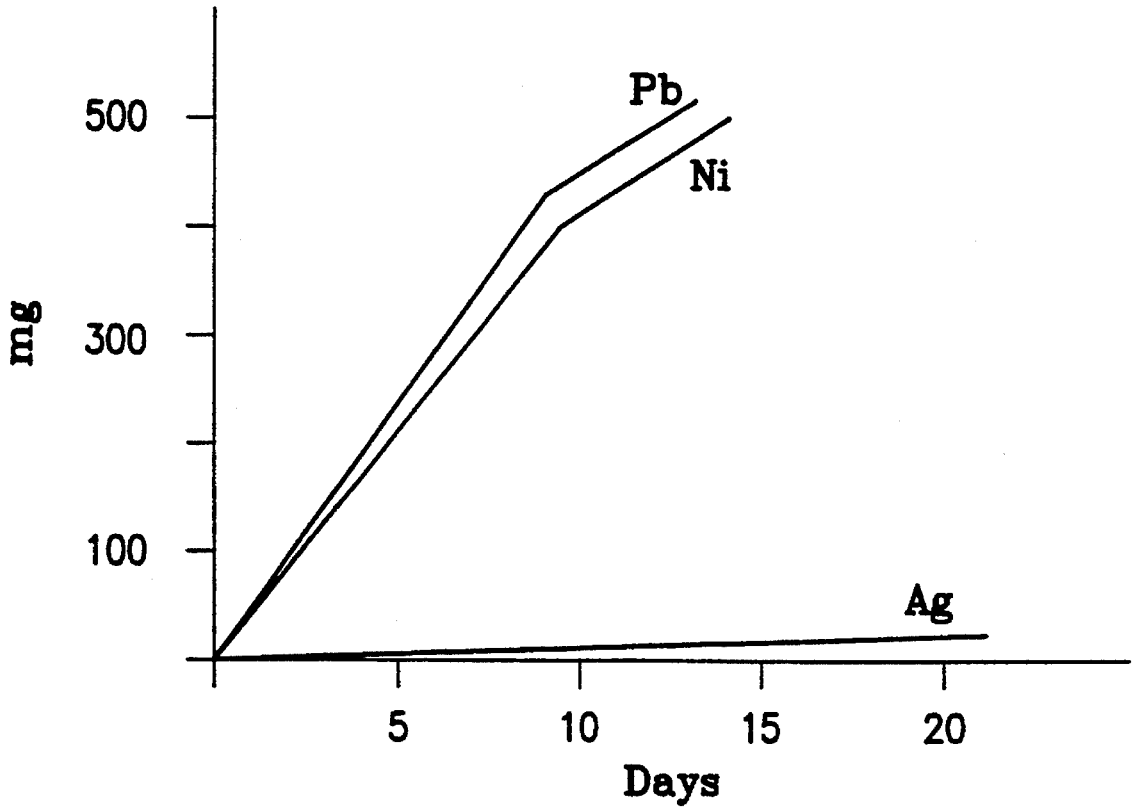
FIGS. 1–4 are diagrams illustrating results from the Examples.
Figure 2:
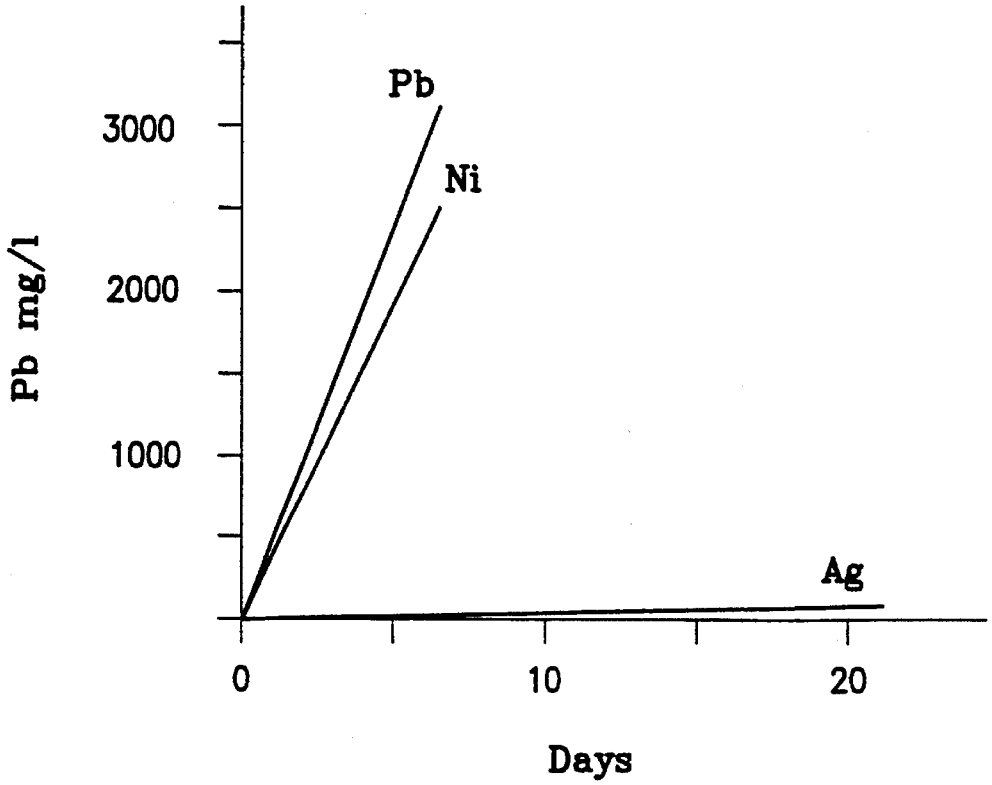
Figure 3:
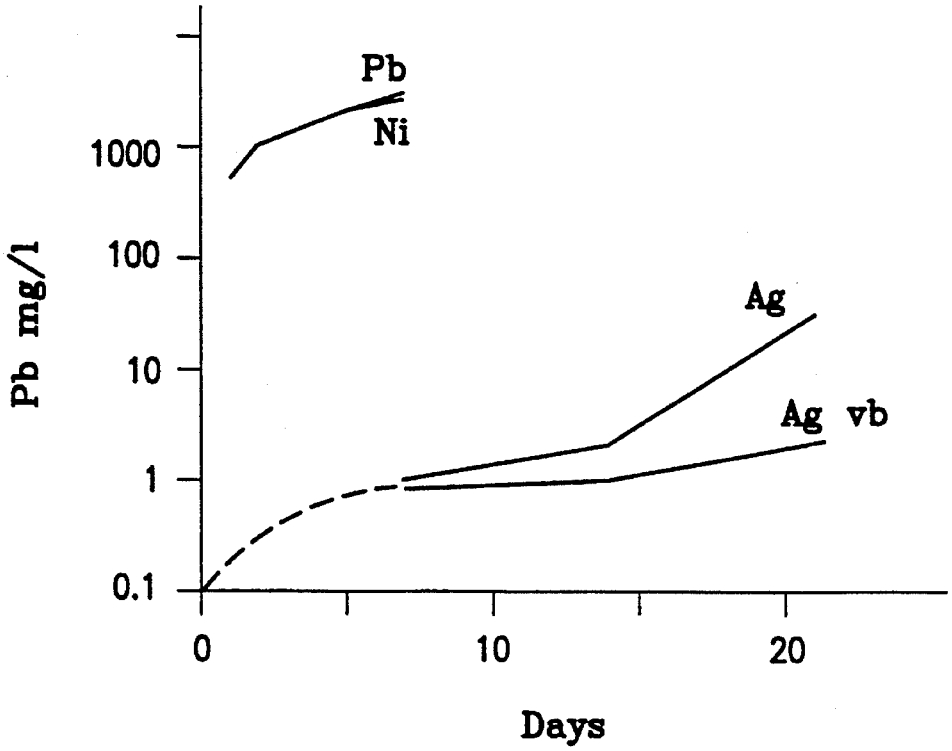
Figure 4:
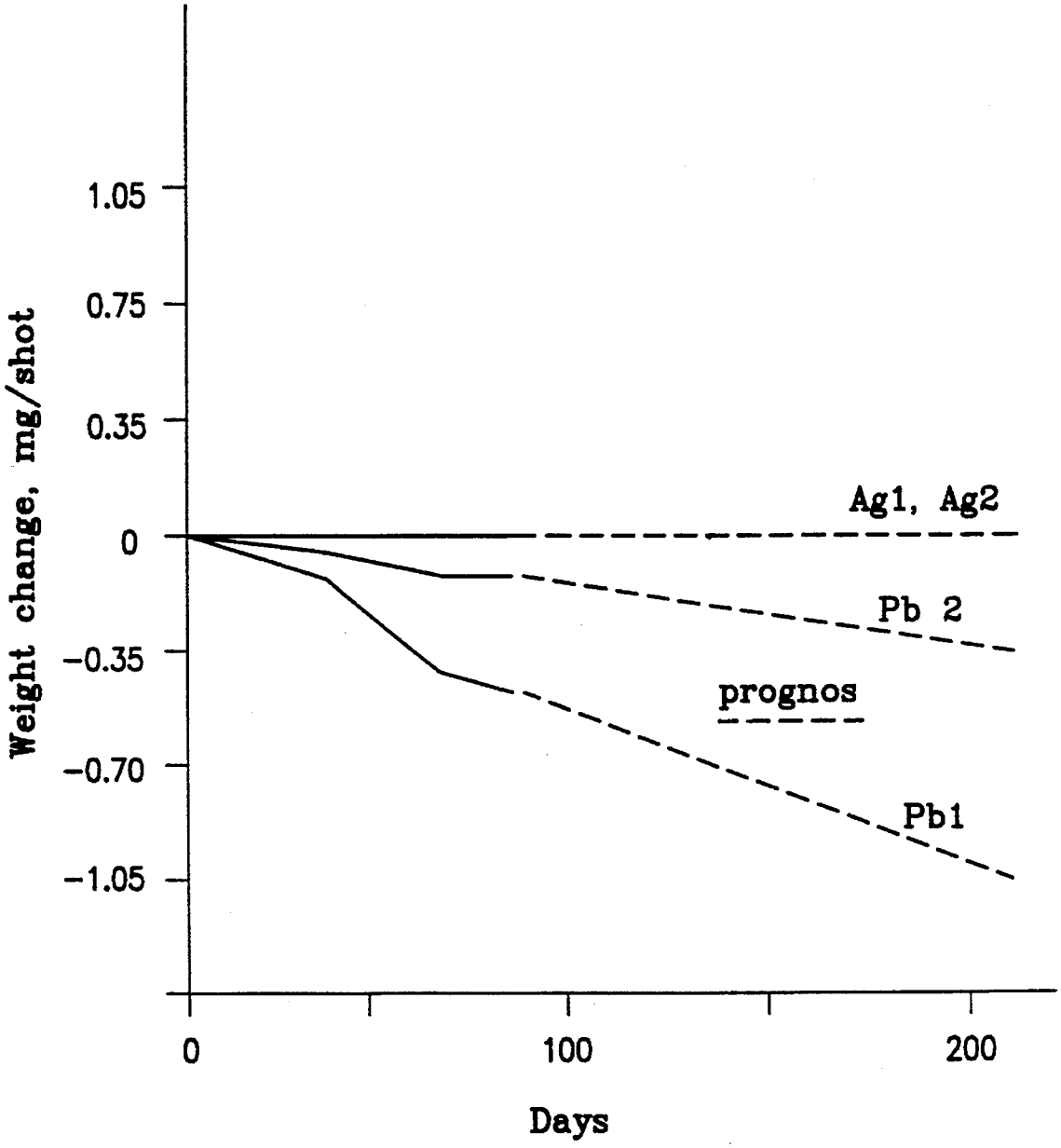
Figure 5:
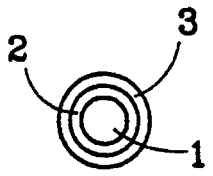
FIG. 5 illustrates a cross section (not to scale) of one embodiment of a shot pellet according to the present invention.

The pellet is produced by coating a pellet core ("1" of FIG. 5) made of lead or lead alloy electrochemically with one or more material layers, of which the outermost layer ("3" of FIG. 5) will always consist of silver or a silver alloy.

The silver or silver alloy may be deposited on the lead core or alternatively on an intermediate layer of ("2" of FIG. 5) copper, for instance, in thin dense layers. The silver or silver-alloy plating is thus effected electromechanically, for instance in an electrolysis bath.

It is preferred that the shot pellet core, either with or without intermediate layers, are pre-treated by cleaning and activating the core surfaces.

At times, adherence of the plating may be favoured by the presence of an intermediate layer which need not exhibit the resistance to hydrochloric acid exhibited by the outer layer but which exhibits good adhesion both to the outer layer and to the pellet core or at least to a further layer surrounding said core.

The method can be carried out advantageously and simply by coating the pellet core with the aid of a continuous electrochemical plating process.

The invention will now be described in more detail with reference to shot pellet manufacturing examples, firing tests, laboratory conducted leaching tests, and also with reference to practical tests and observations carried out on wild duck. The examples are illustrated in FIGS. 1–4, all of which are diagrams which show the results of the tests carried out.

EXAMPLE 1

Lead shot pellets were cleaned in a boiling caustic soda solution. The pellets were then tumbled with sand and water, and thereafter again treated in a caustic bath. The pellets were then silver-plated in a rotating drum at 20°–30° C. in an electrolyte which comprised:

| | g/l |
|---|---|
| Silver | 40 |
| Potassium cyanide | 160 |
| Potassium carbonate | 40 |
| Potassium hydroxide | 1 |
| Glossing agent or lustre | 1–30 |

The anodes used were silver metal anodes of sufficient purity. The plating process was carried out at a current density of 1–3 A/dm$^2$. The pellets were washed repeatedly with water after the plating process.

EXAMPLE 2

Shot pellets produced in accordance with Example 1 and having different layer thicknesses were tested in a shotgun to ascertain the mechanical strength of the pellets when fired from the gun. For evaluating reasons of a technical nature, the tests were carried out with the nozzle of the gun at a distance of only 3 meters from a water surface. This results in a much greater impact force than that generated by shot or pellets striking a water surface from a distance of 25–30 meters, which is a common distance when hunting so-called swimming birds on rivers and lakes, etc.

The shooting test was carried out with six cartridges of 34 grams and containing silver-plated pellets having different layer thicknesses. Firing was effected against the water surface in a barrel filled with water and with a 1 dm foam layer. As before mentioned, the distance of the gun nozzle from the water surface was 3.0 meters. Upon completion of the firing test, the pellets were examined ocularly and sorted into three groups on the basis of appearance. The results are shown in the following Table.

TABLE

| Layer µm | Large gash % | Small gash % | Whole % |
|---|---|---|---|
| 23.3 | 13.7 | 41.5 | 44.8 |
| 34.9 | 7.7 | 20.6 | 71.7 |
| 46.5 | 3.1 | 8.1 | 88.8 |
| 58.2 | 3.5 | 2.3 | 94.3 |

TABLE-continued

| Layer µm | Large gash % | Small gash % | Whole % |
|---|---|---|---|
| 69.8 | 0.8 | 1.2 | 98.0 |
| 81.4 | 1.2 | 2.0 | 96.8 |

The results of this test show that the best results were obtained with pellets that had a layer thickness of 70 µm. The optimal layer thickness will vary with different manufacturing parameters, such as current density and after-treatment, for instance heat-treatment, and these tests merely provide a picture of the extent to which the silver layers remain essential intact when the pellets are fired, said silver layer having been applied to the underlying substrate core to an optimal thickness.

EXAMPLE 3

Conventional lead shot was metered to wild ducks and the livers of the ducks were analyzed after 15 calendar days. It was established that the shot pellet had dissolved at a leaching rate of at least 9.2 mg Pb/pellet/day.

EXAMPLE 4

In laboratory tests carried out on a "simulated" duck stomach (explained in more detail in Example 5), there was obtained for conventional lead shot a leeching rate of 11.2 mg Pb/shot/day, which indicates that the result obtained from the simulated duck stomach was in very close agreement with the result obtained with the test described in Example 3.

EXAMPLE 5

Tests were carried out on simulated duck stomachs in the following way.

5 shot pellets (about 0.6 g)+6.0 g gravel+2 glass balls Ø 25 mm+1 glass ball Ø 16 mm+100 ml of 0.1M HCl were shaken in a Turbula shaker for three weeks. The glass balls were used to increase the pressure on the shot and therewith subject the shot to treatment similar to that to which the shot would be subjected in the stomach muscles of the duck. In this way, the test material was subjected to both mechanical and chemical effect.

pH was measured first on each sampling occasion. 10 ml of sample was then removed for analysis, whereupon a further 10 ml of 0.1M HCl was added. Each pellet was also weighed individually on each sampling occasion, so as to monitor wear on the pellets.

Reference tests were carried out with standard shot pellets, nickel-plated shot pellets and the inventive silver-plated shot pellets produced in accordance with Example 1. These pellets are referenced in the following respectively by Pb, Ni,Ag and Ag vb, wherein Ag identifies silver-plated pellets and Ag vb identifies heat-treated silver-plated pellets. Standard lead pellets (Pb) was tested in the absence of glass balls. Only insignificant differences were found when earlier testing pure lead pellets with and without glass balls. The reduction in weight (measured in mg) of the tested pellets is shown in the diagram in FIG. 1 as a function of time expressed in calendar days. In the linear diagram in FIG. 2, the lead content (mg/1) of the hydrochloric acid samples taken are shown as a function of time expressed in calendar days. This linear scale shows scarcely any dissolution of the silver-plated pellets. The test results from FIG. 2 have been inserted in FIG. 3 in a logarithmic diagram with an enlarged scale, and it will be seen that the silver-plated pellets are essentially fully intact after about 14 calendar days, whereafter leaching begins to occur. Up to 14 calendar days leaching corresponded to 0.003 mg Pb/pellet/day, which is three powers of ten lower than for conventional lead shot pellets (11.2 mg Pb/pellet/day).

EXAMPLE 6

A series of comparison tests were carried out with fired conventional lead shot pellets and silver-plated shot pellets produced in accordance with Example 1 with the intention of evaluating the extent to which lead is leached from pellets fired into the ground. The tests are described in detail below.

10 shot pellets (individually weighed to 5 decimal places) were embedded in natural humus material in an open container. The mixture was moistened initially with acidified water (pH 4) and then intermittently at approximately one-week intervals. The mixture dried-out between the moisturizing occasions (=simulated rain). Two types of humus were used:

1. White moss, pine needles and gravel, etc., from dry heathy pine woodland.
2. Slime-rich material from the shores of a waterway that smelt of sulphuric acid.

The water used was tap water that had been acidified with $H_2SO_4$+$HNO_3$ to pH 4, simulating acid rainwater. The pellets were removed and weighed after 37, 70 and 86 calendar days respectively (accumulated over the three tests). The results can be seen from the diagram in FIG. 4, which shows the change in weight expressed in mg/pellet as a function of time. The diagram also gives a prognosis of the change in weight. The change in weight of lead shot pellets mixed in the two different types of humus have been referenced Pb 1 and Pb 2 respectively (i.e. in humus type 1 and humus type 2). Corresponding references for the silver-plated pellets are Ag 1 and Ag 2. According to the prognosis, a lead shot pellet will have dissolved completely after 75–200 days, depending on the type of humus in which it is embedded. The silver-plated shot pellet showed essentially no change in weight during the test period.

The conclusions that can be drawn from the illustrated examples are as follows:

Tests carried out with conventional lead shot pellets, nickel-plated shot pellets and inventive silver-plated shot have shown that conventional pellets in a simulated duck stomach exhibited a leaching rate of 11.2 mg/pellet/day and the nickel-plated pellets exhibited a leaching rate of 7.3 mg/shot/day in corresponding tests. No tests were carried out with tin-plated shot pellets, as proposed in GB-A 2,111,176, since no such shot pellet was available commercially and neither could any description be found in the literature as to how such pellet could be produced. In analogy with the test results recited in the GB reference and discussed in the introduction to the description, tin-plated shot pellets will exhibit a value within the range of 1–2 mg/pellet/day. During the first 14 days of the test, the silver-plated inventive shot pellets exhibited a leaching rate of only 0.003 mg Pb/pellet/day, i.e. a leaching rate which lies more than three powers of ten below the leaching rate of lead shot pellets and immediately beneath three powers of ten lower than the leaching rate of tin-plated shot pellets. The first 14 days have been chosen for this comparison because in practice a longer time period is of no interest, since the average residence time of pellet in the gizzards of birds is only from 7–15 calendar days, as indicated in the aforegoing.

The tests also show that the silver-plated shot pellets are not measurably affected by humus, and consequently it is believed that no lead at all will leach into the ground on which the pellets fall, in sharp contrast to the conventional shot pellets.

It can also be mentioned that in conjunction with the tests reported in the examples above, observations were also made on the gizzard of a wild duck, in which stones, gravel and grass seeds were found. These seeds resemble lead shot pellets in shape, colour and size. It is therefore obvious that birds will eat shot pellets in the belief that they are desirable grass seed. Literature indicates that the gizzard of sea birds can contain up to 62 shot pellets, even though the normal number is from one to three shots. It should be noted in this context that the inventive silver-plated shot pellets will distinguish from other materials primarily with regard to colour, since the pellet surface has a high lustre. The outer surface is also serrated to a large extent as it is shot from the gun. The risk of birds mistaking such pellets for grass seeds is therefore much smaller than in the case of conventional shot, and consequently this specific property of the inventive shot, which was not greatly affected by the humus tests carried out, is particularly favourable towards eliminating essentially those problems encountered with the use of lead shot pellets for hunting wild game, particularly so-called swimming birds such as ducks and recited in the introduction.

I claim:

1. Shot pellets having (i) an inner core comprising a material selected from the group consisting of lead and lead alloys and (ii) an electrochemically deposited outer layer comprising a material selected from the group consisting of silver and silver alloys, which shot pellets, after firing, do not leach any substantial amounts of lead into the surrounding environment.

2. Shot pellets according to claim 1, further comprising an intermediate layer comprising a material selected from the group consisting of copper and copper alloys, which intermediate layer is between the inner core and the outer layer.

3. A method for producing shot pellets comprising applying at least one layer electrochemically to shot pellet cores, which cores comprise a material selected from the group consisting of lead and lead alloys, wherein the electrochemically applied layer which is outermost from the core comprises a material selected from the group consisting of silver and silver alloys and further wherein the shot pellets have an intermediate layer comprising a material selected from the group consisting of copper and copper alloys which is between the core and the outermost layer.

4. A method according to claim 3, wherein the shot pellet cores are lead shot pellets.

5. A method according to claim 4, further comprising pre-treating the shot pellet cores by cleaning and activating the cores.

6. A method according to claim 5, further comprising an after-treatment of controlled heating so as to provide a denser and more durable layer.

7. A method according to claim 6, wherein the intermediate layer comprises a material having an adhesive effect on that material lying inwardly and outwardly with respect thereto.

8. A method according to claim 7, wherein the shot pellet cores are coated by a continuous electrochemical plating process.

9. A method according to claim 3, further comprising pre-treating the shot pellet cores by cleaning and activating the cores.

10. A method according to claim 3, further comprising an after-treatment of controlled heating so as to provide a denser and more durable layer.

11. A method according to claim 3, wherein the intermediate layer comprises a material having an adhesive effect on that material lying inwardly and outwardly with respect thereto.

12. A method according to claim 3, wherein the shot pellet cores are coated by a continuous electrochemical plating process.

13. A method for producing shot pellets comprises applying at least one layer electrochemically to shot pellet cores, which cores comprise a material selected from the group consisting of lead and lead alloys, wherein the electrochemically deposited layer which is outermost from the core comprises a material selected from the group consisting of silver and silver alloys.

14. A method according to claim 13, wherein the shot pellet cores are lead shot pellets.

15. A method according to claim 14, further comprising pre-treating the shot pellet cores by cleaning and activating the cores.

16. A method according to claim 15, further comprising an after-treatment controlled heating so as to provide a denser and more durable layer.

17. A method according to claim 16, further comprising applying an intermediate layer between the core and the at least one layer, wherein the intermediate layer comprises a material that has an adhesive effect on that material lying inwardly and outwardly with respect thereto.

18. A method according to claim 17, wherein the shot pellet cores are coated by a continuous electrochemical plating process.

19. A method according to claim 13, further comprising pre-treating the shot pellet cores by cleaning and activating the cores.

20. A method according to claim 13, further comprising an after-treatment of controlled heating so as to provide a denser and more durable layer.

21. A method according to claim 13, further comprising applying an intermediate layer between the core and the at least one layer, wherein the intermediate layer comprises a material that has an adhesive effect on that material lying inwardly and outwardly with respect thereto.

22. A method according to claim 13, wherein the shot pellet cores are coated by a continuous electrochemical plating process.

* * * * *

UNITED STATES PATENT AND TRADEMARK OFFICE
CERTIFICATE OF CORRECTION

PATENT NO. : 5,528,988

DATED: : June 25, 1996

INVENTOR(S) : Per-Olof LINDGREN et al

It is certified that error appears in the above-identified patent and that said Letters Patent is hereby corrected as shown below:

On the title page, item [56], add the two "References Cited" below:

| | | | |
|---|---|---|---|
| U.S. Patent Documents: | 5,088,415 | 1/92 | Huffman et al |
| Foreign Patent Documents: | 2,111,176 | 6/83 | United Kingdom |

Signed and Sealed this

Twenty-third Day of December, 1997

*Attest:*

*Attesting Officer*

BRUCE LEHMAN

*Commissioner of Patents and Trademarks*